United States Patent [19]

Philpot et al.

[11] Patent Number: 5,072,525

[45] Date of Patent: Dec. 17, 1991

[54] PRINT ANALYSIS SYSTEM

[75] Inventors: Ivan N. Philpot; Bruce G. Bittick, both of Irving, Tex.

[73] Assignee: Matthews International Corporation, Pittsburgh, Pa.

[21] Appl. No.: 606,232

[22] Filed: Oct. 31, 1990

[51] Int. Cl.[5] ..... B41B 1/00

[52] U.S. Cl. ..... 33/618; 101/DIG. 36

[58] Field of Search ..... 33/613, 614, 618, 620; 101/171, 211, DIG. 36

[56] References Cited

U.S. PATENT DOCUMENTS

| | | | |
|---|---|---|---|
| 2,994,964 | 8/1961 | Moffet . | |
| 3,081,551 | 3/1963 | Kraus . | |
| 3,099,092 | 7/1963 | Crance . | |
| 3,119,330 | 1/1964 | Kunetka | 101/DIG. 36 |
| 3,434,217 | 3/1969 | Abbott | 33/618 |
| 4,469,025 | 9/1984 | Lofiler et al. | 101/171 |
| 4,827,626 | 5/1989 | Wieland | 33/614 |

*Primary Examiner*—Harry N. Haroian

*Attorney, Agent, or Firm*—Armstrong, Nikaido, Marmelstein, Kubovcik & Murray

[57] ABSTRACT

Provided by the present invention, is an apparatus for and a method of ensuring an accurate parallel alignment between working surfaces of various rolls or cylinders disposed in a print station of a package printing arrangement. Further, this invnetion provides a method of and an apparatus for establishing substantial synchronization of the rotational speed of the working surface of a printing plate cylinder with the linear speed of a substrate material to be printed in a package printing arrangement. Additionally, this invention teaches an apparatus for and a method of providing documentation of certain preselected screen values and a percent of an image maintained by a particular printing arrangement.

53 Claims, 5 Drawing Sheets

PRINT ANALYSIS SYSTEM

FIELD OF THE INVENTION

The present invention relates, in general, to printing arrangements which are commonly used in the packaging industry and, more particularly, this invention relates to a method of and an apparatus for providing an accurate parallel alignment between each of an impression cylinder and a printing plate cylinder, as well as, between an anilox roll and such printing plate cylinder disposed in at least one print station of such printing arrangement. This invention also provides a method of and an apparatus for ensuring substantial synchronization of the rotational speed of the working surface of such printing plate cylinder to the linear speed of a substrate surface to be printed in such printing arrangement. Further, this invention provides a method of and an apparatus for providing documentation of certain preselected screen values and a percent of image maintained by a particular printing arrangement. Additionally, this invention provides a method of and an apparatus for evaluating at least one preselected critical print characteristic encountered in such printing arrangement.

BACKGROUND OF THE INVENTION

At the present time, it is becoming increasingly the normal practice in the retail sales industry to use what is called "point of sales" packaging for the majority of products offered for sale in retail outlets. This practice is forcing the packaging industry to both develop and implement equipment and practices which will provide an improvement in the quality of printing. In other words, the former "brown box" is now bursting with color and more complex graphics are making the product packages a "selling tool." This is particularly the situation being encountered in the corrugated box industry.

Unfortunately, there are a significant number of variables encountered in a printing arrangement which can adversely affect the quality of the finished printed product. Although not necessarily limited thereto, these variables include the following. the parallelism, within acceptable tolerances, between the anilox roll and the printing plate cylinder as well as the parallelism between the impression cylinder and such printing plate cylinder; establishment of the zero point, i.e., the point at which the cylinders are properly spaced from one another; synchronization between the rotational speed of the working surface of the printing plate cylinder and the surface of the substrate to be printed thereon; and, various print characteristics which are well known in the art. Such print characteristics encountered in a print arrangement at least include: screens, positive and reverse graduated type; bar codes; solids; impression; slippage; and, distortion.

Prior to the present invention, it has been taught in U.S. Pat. No. 2,994,964 to use a transparent gauge for aligning the paper and/or metal master plate onto the working surface of a print cylinder disposed in an offset printing press. This transparent gauge is adjustably secured to a bar member that, in turn, is attached to the frame which supports such print cylinder. The bar member enables such gauge to be moved in a lateral manner across the printing plate to be registered in the press, if and when different sized master plates are required to be aligned. In addition, it can be seen that such transparent gauge is hinged along its midsection. The purpose of the hinged connection is to allow the gauge to be readily moved out of position after registry has been achieved so as not to unduly hinder observation of the printing operation by the press operator.

In addition, U.S. Pat. No. 3,099,092 teaches a gauge useful in verifying the position of registry marks which are located on a printed sheet. This prior art gauge includes a member having one end portion of plate-like shape. Such plate-like shaped member is adapted for insertion under the edge of a printed sheet. Such printed sheet being provided with registry marks located along the margin width. Such gauge includes another end portion that is provided with a plurality of parallel guide means and a positioning abutment extending transversely of such guide means. The one end portion is marked with a linear scale of preselected margin widths. Such margin widths being measured from the abutment. A plurality of relatively spaced parallel slides are slidably adjustable in such guide means, respectively, above such end portion. Such parallel slides are made from a transparent material. Each such parallel slide being provided with a mark that is adapted to be positioned in register with a selected indicia of such linear scales and, thereafter, applied to register marks, respectively, of such printed sheet. An edge of such printed sheet being interposed between such member and such slide and against the abutment. In this manner, the position of such register marks on such printed sheet can be verified.

The prior art further teaches in U.S. Pat. No. 4,469,025 a device useful in film-mounting print control strips at a precise level and in registry. According to this invention, this device consists of a foil forming a template for a mounting foil used when mounting a print control strip. Such foil template contains the ink as well as the measuring-field information that is required for film mounting at a precise level and in good registry. Further, this device includes a characteristic representation of the printing plate center.

Finally, a method of and an apparatus for measuring and correcting register error that are often encountered in multi-color printing equipment is taught in U.S. Pat. No. 4,827,626. In this prior art method and apparatus, a multi-color sheet that has been printed, having register marks for each color is placed on a measuring table. The approximate location of the register pairs and the accurate spacings of the individual register marks in each pair are then determined by one of a light stylus, an electronic color video measuring camera system or on a measuring table equipped with a digitizer surface. The values obtained by one of these pieces of equipment are entered into a computer. Such computer then calculates the corrective values to be used to reposition one or more of the printing plates being carried by the working surface of each printing plate cylinder to achieve the required color registry in a multi-color printing arrangement.

As will be readily understood and recognized by persons skilled in the printing art, however, none of the above-discussed references, either singularly or taken in combination, are capable of meeting the performance or objectives of the present invention to be discussed hereinafter.

SUMMARY OF THE INVENTION

According to one aspect of the present invention, there is provided a gauging instrument which will provide an accurate alignment at least between an impression cylinder and a printing plate cylinder. This gauging instrument can also be used to provide an accurate alignment between the anilox roll and such printing plate cylinder as well as determining the zero point which will ensure a true impression on the print system. This gauging instrument includes at least one generally flexible member having each of a predetermined length, a predetermined width and a predetermined thickness. A back surface of the flexible member is engageable with the outer working surface of such printing plate cylinder. Disposed on an upper surface of such flexible member is a first set of raised indicia which represent a zero point between such impression cylinder and such printing plate cylinder and between such anilox roll and such printing plate cylinder. This first set of indicia extends outwardly from the upper surface of such flexible member for a predetermined distance. In addition, there are at least two sets of indicia disposed at predetermined locations on such upper surfaces of such flexible member which represent a positive distance such gap established between such impression cylinder and such printing plate cylinder is from such zero point. These second set of indicia have a third predetermined thickness. Finally, there are at least two third sets of indicia, disposed at predetermined locations on such upper surface of such flexible member, which represent a negative distance of such gap established between such impression cylinder and such printing plate cylinder is from such zero point. Such third sets of indicia have a fourth predetermined thickness.

According to a second aspect of the present invention, there is provided a method of establishing substantial parallelism between adjacent working surfaces of an anilox roll and a printing plate cylinder in addition to between such printing plate cylinder and an impression cylinder in a printing system. Such method comprises the steps of: (1) opening a first print station disposed in such printing system; (2) positioning a back surface of at least one gauging instrument, having a plurality of predetermined markings disposed on an opposed outer surface thereof, on a working surface of the printing plate cylinder in a position such that certain selected markings located adjacent each end of such gauging instrument are toward each other; (3) adjusting the anilox roll until a working surface thereof makes contact with at least a portion of such plurality of markings on the outer surface of such gauging instrument so that inking of such at least a portion of the plurality of markings will be achieved; (4) comparing readings on such plurality of markings to determine if inking achieved in step (3) is occurring substantially equal across the printing plate cylinder; (5) indicating by such predetermined markings a degree to which such adjacent working surfaces of such anilox roll and such printing plate cylinder are out of parallelism when it is determined in step (4) that the inking achieved in step (3) is not substantially equal across such printing plate cylinder; (6) making necessary adjustments indicated in step (5) to establish parallelism between the adjacent working surfaces of such anilox roll and such printing plate cylinder; (7) cleaning the gauging instrument; (8) repeating steps (5) through (7) until such inking is substantially equal across such printing plate cylinder; (8) repeating step (7) once the inking is substantially equal across such printing plate cylinder; (9) inking such gauging instrument; (10) increasing impression of such impression cylinder with the printing plate cylinder at least until contact is achieved between at least a portion of such plurality of markings on such outer surface of the gauging instrument and one of such working surface of the impression cylinder and a surface of a substrate material; (11) transferring ink readings from such gauging instrument to such one of such working surface of such impression cylinder and the surface of such substrate material; (12) comparing ink readings transferred in step (11) to determine if inking is occurring substantially at a same degree across such one of such working surface of the impression cylinder and the surface of such substrate material; (13) indicating by such predetermined markings a degree to which the adjacent working surfaces of the impression cylinder and the printing plate cylinder are out of parallelism when it is determined in step (12) that such ink reading transferred in step (11) is not substantially equal across such one of such working surface of such impression cylinder and such surface of such substrate material; (14) making necessary adjustments indicated in step (13) when the ink readings are not substantially equal; (15) repeating steps (8) through (14) until such ink readings are substantially equal; and (16) repeating steps (1) through (15) for each print station in such printing system.

A third aspect of the present invention involves the provision of a speed synchronization apparatus for ensuring substantial synchronization of a rotational speed of a working surface of a printing plate cylinder with a linear speed of a substrate surface which is to receive printed matter thereon in a printing arrangement. Such speed synchronization apparatus includes at least one printing instrument member having a back surface thereof engageable with such working surface of such printing plate cylinder disposed in such printing arrangement. Such printing instrument member having a predetermined number of predetermined indicia disposed on an upper surface thereof which are positioned at predetermined locations for determining both when slippage occurs and where such slippage occurs during operation of such printing arrangement. Such speed synchronization apparatus also includes at least one line screen member having a back surface thereof engageable with such working surface of such printing plate cylinder disposed in such printing arrangement. This line screen member having a predetermined number of substantially horizontal lines which create on such substrate surface at least one predetermined character and a predetermined number of substantially vertical lines which create a background for such predetermined character on such substrate surface. Such line screen member enabling a determination to be made of at least one of such substrate surface travelling at a greater rate of speed than such printing plate cylinder and such printing plate cylinder travelling at a greater rate of speed than such substrate surface.

In a fourth aspect of the present invention, there is provided a method of synchronizing a rotational speed of a working surface of a printing plate cylinder with a linear speed of a substrate surface which is to receive printed matter thereon in a printing arrangement, such method includes the steps of: (1) positioning a printing instrument sync scale member on a working surface of a printing plate cylinder disposed in such printing arrangement. This sync scale member having a predetermined number of substantially equally spaced preselected indicia positioned adjacent at least one outer edge thereof; (2) feeding a substrate material through the printing arrangement; (3) printing such indicia on a surface of the substrate material simultaneously while feeding it through such printing arrangement in step (2); (4) measuring a distance between each indicia printed on the surface of such substrate material in step (3) to determine both if slippage occurred and where slippage occurred; (5) making necessary adjustments in such printing arrangement to eliminate such slippage; (6) repeating steps (2) through (5) until the slippage has been eliminated; (7) removing the printing instrument sync scale member from the working surface of such printing plate cylinder; (8) positioning a line screen sync scale member on the working surface of such printing plate cylinder. Such line screen sync member having a plurality of substantially horizontal lines which create at least one predetermined character on such surface of such substrate material and a plurality of substantially vertical lines which create a background for such predetermined character on the surface of such substrate material; (9) feeding the substrate material through the printing arrangement; (10) printing such plurality of horizontal lines and such plurality of vertical lines on such surface of such substrate material simultaneously while feeding it through the printing arrangement in step (9); (11) observing an image printed on the surface of such substrate material in step (10); (12) determining from such image observed in step (11) when at least one of such substrate material is travelling faster than such printing plate cylinder and such printing plate cylinder is travelling faster than such substrate material; (13) making necessary adjustments in such printing arrangement to synchronize the rotational speed of such printing plate cylinder with such linear speed of the substrate material; 14) repeating steps (9) through (13) until substantial synchronization of such rotational speed of the printing plate cylinder and the substrate material is achieved; (15) removing such line screen sync scale member from the printing plate cylinder; and (16) repeating steps (1) through (16) for each print station in such printing arrangement.

The present invention further provides in a fifth aspect, a printing instrument useful in a printing arrangement for printing on at least a portion of a preselected substrate material a report card that will provide substantially precise documentation of at least each of preselected screen values and a percentage of an image maintained by a particular print station disposed in such printing arrangement. This printing instrument comprises a first printing member having each of a first predetermined width and a first predetermined length and a first predetermined thickness. A back surface of such first printing member being engageable with and securable to a working surface of a printing plate cylinder disposed in such print station of such printing arrangement. Such first printing member having a first set of indicia arranged on an axially opposed upper surface thereof, which when printed on a surface of such substrate material will indicate across a predetermined width thereof graduated screen values of a first preselected line value and such percentage of such image maintained by such print station at such first predetermined line value. This printing instrument also includes a second printing member having each of a second predetermined width and a second predetermined length and a second predetermined thickness. A first elongated edge of such second printing member being disposed adjacent a first elongated edge of such first printing member. A back surface of such second printing member being engageable with and securable to such working surface of such printing plate cylinder. Such second printing member having a second set of indicia arranged on an axially opposed upper surface thereof, which when printed on such surface of such substrate material will indicate across a predetermined width thereof a screen value of a second preselected line value and such percentage of such image maintained by such print station at such second preselected line value.

A method of providing substantially precise documentation of a plurality of preselected screen values and a percent of an image maintained by a particular printing arrangement is provided in a sixth aspect of the present invention. This method includes the steps of: (1) establishing parallelism between an anilox roll and a printing plate cylinder disposed in a print station located in such printing arrangement and between such printing plate cylinder and an impression cylinder; (2) establishing synchronization of a rotational speed of such printing plate cylinder with a linear speed of a surface of substrate material to be printed thereon; (3) mounting a printing instrument on a working surface of the printing plate cylinder which will print on such surface of the substrate material a report card which when printed on the surface of such substrate material is capable of providing such precise documentation of the preselected screen values and the percent of such image maintained; (4) ensuring a predetermined printing instrument impression to such anilox roll; (5) disengaging all print stations in such printing arrangement not being used; (6) running such substrate material through the printing arrangement; (7) inspecting a resulting printed sheet; (8) adjusting such print station as required based on inspection of such printed sheet in step (7); (8) repeating steps (4) through (8) until such printed sheet meets specified requirements for a particular job; (9) documenting at least some print statistics obtained in step (8); (10) washing the printing instrument while mounted on such printing plate cylinder; (11) rinsing the printing instrument while mounted on such printing plate cylinder; (12) drying such printing instrument while mounted on the printing plate cylinder; (13) repeating steps (1) through (12) for each print station to be used on a particular job; (14) repeating steps (10) through (13) after a final print station has been adjusted; and (15) removing such printing instrument from such printing plate cylinder.

A seventh aspect of the present invention provides a printing arrangement diagnostic testing instrument having preselected components for evaluating preselected print characteristics. Such diagnostic testing instrument comprises at least one printing instrument means for evaluating a plurality of preselected screen values. Further there is at least one printing instrument means for evaluating bar codes provided. This diagnostic testing instrument also includes at least one printing instrument for evaluating impressions. Also, at least one printing instrument means for evaluating slippage is provided as well as at least one printing instrument means for evaluating distortion.

In a final aspect of the present invention, a print analysis system which provides enhanced print quality in a package-type printing system is taught. Such print analysis system comprises at least one gauge means engageable with at least a portion of a working surface of a printing plate cylinder for establishing parallelism between a working surface of an anilox roll and such working surface of such printing plate cylinder and between a working surface of an impression cylinder and such working surface of the printing plate cylinder. This print analysis system simultaneously establishes a zero point between such working surfaces of such anilox roll and such printing plate cylinder and between a working surface of an impression cylinder and such working surface of such printing plate cylinder and simultaneously establishes a zero point between such working surfaces of such anilox roll and such printing plate cylinder and between such working surfaces of such impression cylinder and such printing plate cylinder. Such print analysis system has a speed synchronization means engageable with at least a portion of such working surfaces of such printing plate cylinder for substantially synchronizing a rotational speed of such working surface of such printing plate cylinder with a feeding speed of a substrate surface to be printed in such package-type printing system. A documentation means engageable with at least a portion of such working surface of such printing plate cylinder for providing documentation of at least one of screen value and a percent image that is maintained by at least one individual print station in such package-type printing system is included in this print analysis system. Finally, the print analysis system includes a print characteristic evaluation means engageable with at least a portion of such working surface of such printing plate cylinder for evaluating print characteristics of at least one of positive screens, reverse graduated-type screens, bar codes, solids, impressions, slippage and distortion and for printing a multi-color process graphic which can be analyzed to ensure maintenance of peak print performance in such package-type printing system.

OBJECTS OF THE INVENTION

It is, therefore, one of the primary objects of the present invention to provide a test apparatus which will ensure improved print quality in a print station disposed in a printing arrangement.

Another object of the present invention is to provide a test apparatus which will significantly reduce the amount of scrap generated in a printing arrangement.

Still another object of the present invention is to provide a test apparatus which will substantially reduce the wear on an anilox roll disposed in a print station of a printing arrangement.

Yet another object of the present invention is to provide a test apparatus which will minimize press downtime in a printing arrangement.

A further object of the present invention is to provide a test apparatus which will ensure enhanced color-to-color registration in a printing arrangement.

It is an additional object of the present invention to provide a test apparatus for printing arrangement which will significantly reduce board crush during a printing operation.

Another object of the present invention is to provide a test apparatus for a printing arrangement which will establish benchmarks to be used therein.

Still another object of the present invention is to provide a test method for a printing arrangement which will ensure enhanced print quality of such printing arrangement.

Yet another object of the present invention is to provide a test method for a printing arrangement which will result in less scrap being generating in such printing arrangement.

A still further object of the present invention is to provide a test method for a printing arrangement which will result in reduced wear on the anilox roll disposed in a print station of such printing arrangement.

It is an additional object of the present invention to provide a test method for a printing arrangement which will result in reduced downtime being required for such printing arrangement.

Another object of the present invention to provide a test method for a printing arrangement which will enable enhanced color-to-color registration to be achieved by such printing arrangement.

Still yet another object of the present invention is to provide a test method for a printing arrangement which will significantly reduce the amount of board crush encountered in such printing arrangement.

Yet still another object of the present invention is to provide a test method for a printing arrangement which will enable benchmarks to be established for such printing arrangement.

A further object of the present invention is to provide a method of and an apparatus for testing a printing arrangement which is cost effective.

An additional object of the present invention is to provide a method of and an apparatus for testing a print arrangement that is reliable.

In addition to the various objects and advantages of the present invention which have been described in detail above, various other objects and advantages of the print analysis system will become more readily apparent to those persons who are skilled in the package printing art from the following more detailed description of the invention particularly when such description is taken in conjunction with the attached drawings and with the appended claims.

BRIEF DESCRIPTION OF THE INVENTION

Figure 1:
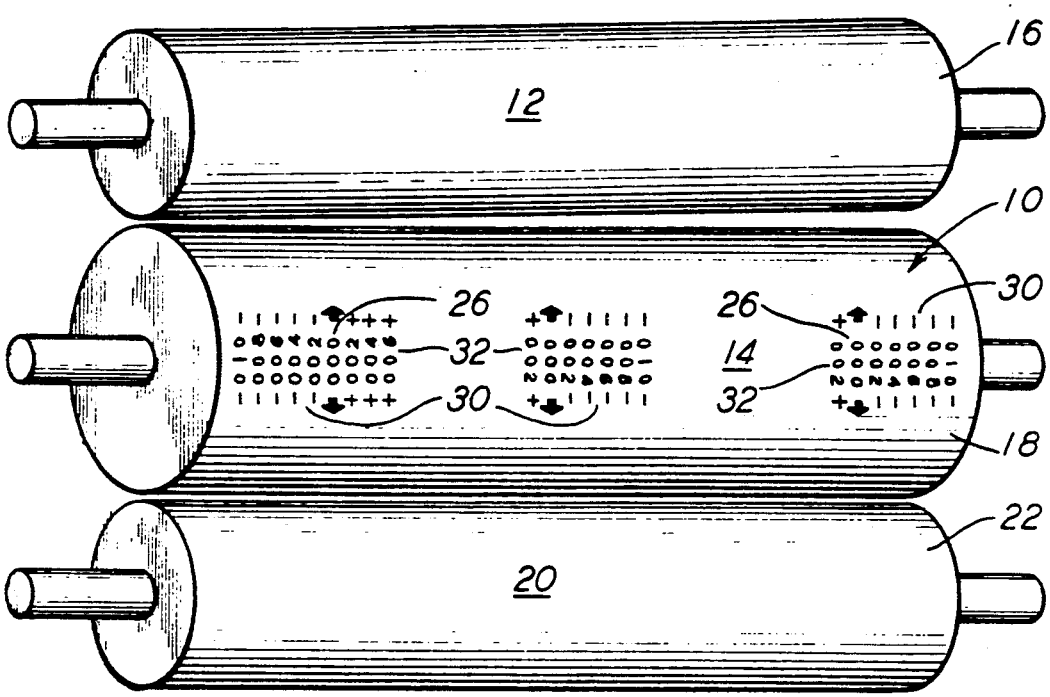
FIG. 1 is a front view showing one embodiment of a gauge means for establishing parallelism and a zero point between working surfaces of rolls disposed in a print station of a printing arrangement.
Figure 2:
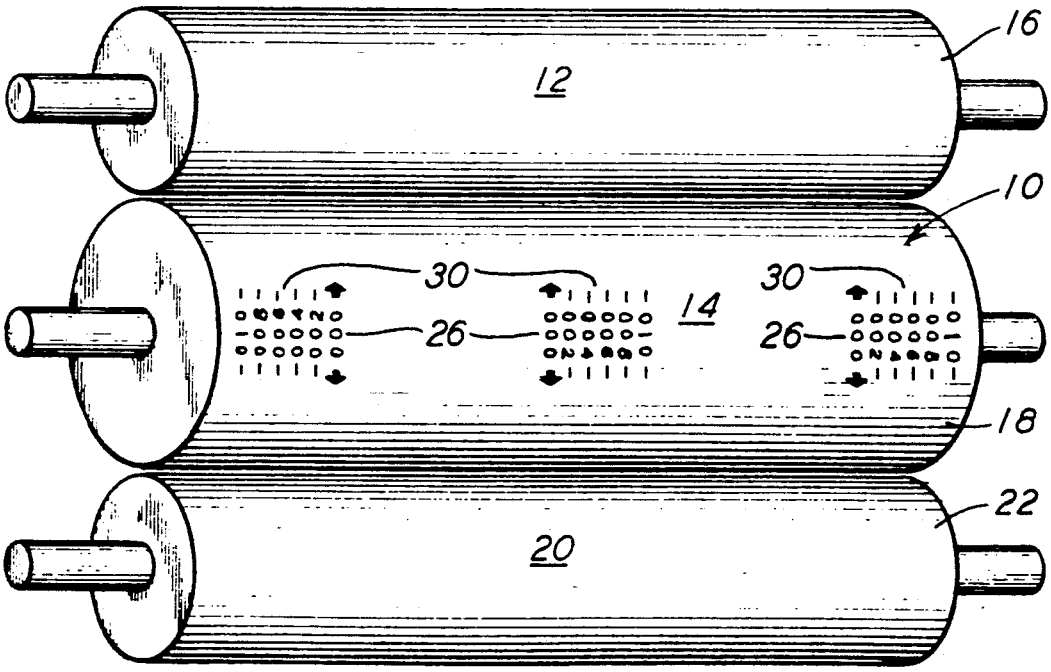
FIG. 2 is a front view illustrating an alternative embodiment of a gauge means for establishing parallelism and a zero point between working surfaces of rolls disposed in a print station of a printing arrangement.
Figure 3:
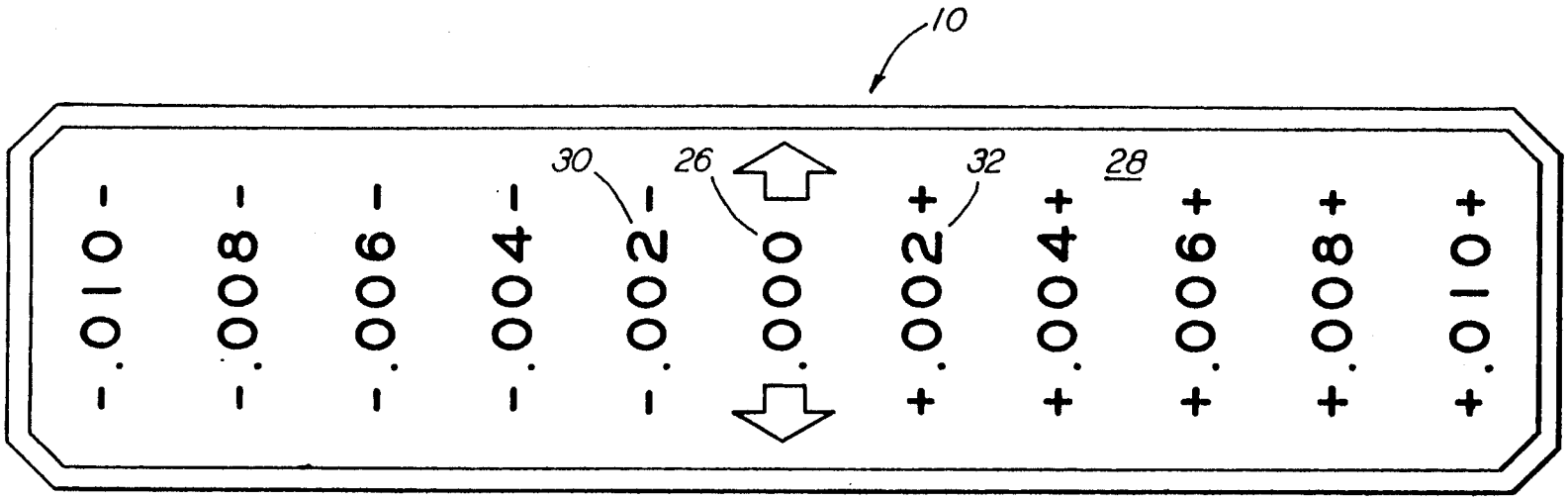
FIG. 3 is a top view illustrating a presently preferred gauge means useful in a print station illustrated in FIGS. 1 and 2.
Figure 4:
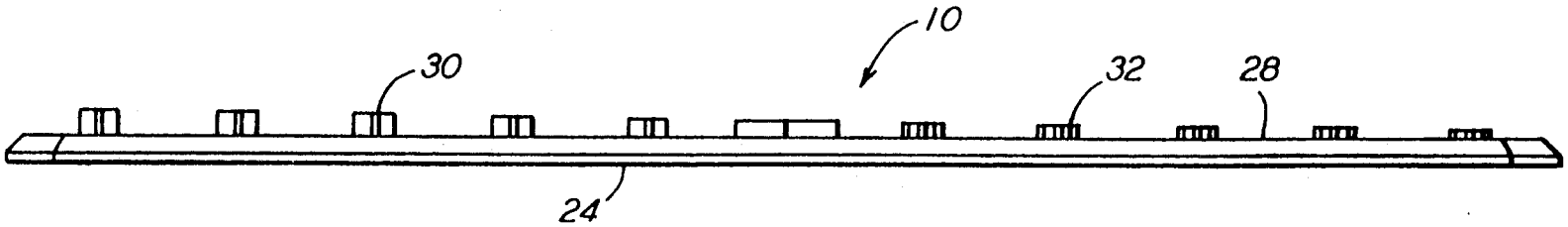
FIG. 4 is a side elevation view of the gauge means illustrated in FIG. 3.

Prior to proceeding to a more detailed description of the present invention, it should be noted that, for the sake of clarity, identical components having identical functions have been designated by identical reference numerals.

Now refer more particularly to FIGS. 1 through 4. Illustrated therein is a gauging instrument, generally designated 10, which provides alignment in a printing arrangement (not shown) between adjacent working surfaces 12 and 14, respectively, of an anilox roll 16 and a printing plate cylinder 18 and between adjacent working surfaces 14 and 20, respectively, of such printing plate cylinder 18 and an impression cylinder 22 so that substantial parallelism can be established between such adjacent working surfaces 12 and 14 of such anilox roll 16 and such printing plate cylinder 18 and such adjacent working surfaces 14 and 20 in each print station (not shown) disposed in such printing arrangement. This gauging instrument comprises at least one generally flexible member 10 having a predetermined length, a predetermined width and a first predetermined thickness. A back surface 24 of such flexible member 10 being engageable with at least a portion of the outer working surface 14 of such printing plate cylinder 18. At least two first sets of indicia 26 are disposed at predetermined locations on a upper surface 28 of such flexible member 10. Such first sets of indicia 26 represent a zero point of a gap established between such working surface 20 of the impression cylinder 22 and such working surface 14 of the printing plate cylinder 18. These first sets of indicia 26 having a second predetermined thickness. Further provided are at least two second sets of indicia 30 which are disposed at predetermined locations on such upper surface 28 of the flexible member 10. These second sets of indicia 30 represent a positive distance such gap established between such impression cylinder 22 and such printing plate cylinder 18 is from such zero point. Such second sets of indicia 30 having a third predetermined thickness. This gauge instrument 10 further includes at least two third sets of indicia 32 which are disposed at predetermined locations on such upper surface 28 of such flexible member 10. These third sets of indicia 32 represent a negative distance of such gap established between such impression cylinder 22 and such printing plate cylinder 18 is from such zero point. Such third sets of indicia having a fourth predetermined thickness.

According to a presently preferred embodiment of the invention, such gauging instrument 10 will further include a magnetic backing member (not shown) disposed on such back surface 24 of such flexible member 10 for holding such gauging instrument 10 in place on such working surface 14 of such printing plate cylinder 18.

Each of such first sets of indicia 26 and such second sets of indicia 30 and such third sets of indicia 32 are generally flexible in the presently preferred embodiment of this invention. Also, in this embodiment such flexible member 10 and such first sets of indicia 26 and such second sets of indicia 30 and third sets of indicia 32 will be molded as a single piece unit.

In a still more preferred embodiment of the invention such gauging instrument 10, for providing accurate alignment in a printing arrangement includes three first sets of indicia 26 representing such zero point. A first of such sets of indicia 26 representing the zero point is disposed adjacent a first end of such gauging instrument 10. A second of such sets of indicia 26 representing such zero point is disposed adjacent an axially opposed second end of such gauging instrument 10 and a third of these sets of indicia 26 representing such zero point will be disposed substantially midway between such first of such sets and such second of the sets of indicia 26 representing such zero point.

Likewise, in the more preferred embodiment of this invention, such gauging instrument 10 includes at least three second sets of indicia 30 representing such positive distance. A first of such second sets of indicia 30 representing such positive distance is disposed intermediate such first of such sets of indicia 26 representing the zero point and such third of such sets of indicia 26 representing such zero point at a location closely adjacent such first of such sets of indicia representing such zero point. A second of such second sets of indicia 30 representing such positive distance is disposed intermediate such second of such sets of indicia 26 representing such zero point and such third of the sets of indicia 26 representing such zero point at a location closely adjacent such second of the sets of indicia 26 representing such zero point. The third of these second sets of indicia 30 representing such positive distance will be disposed intermediate such first of said sets of indicia 26 representing such zero point and said third set of indicia representing such zero point at a location closely adjacent such third of such sets of indicia 26 representing the zero point.

In addition, the gauging instrument 10 for providing accurate alignment in a printing arrangement, in the more preferred embodiment of the present invention, includes at least three third sets of indicia 32 representing such negative distance. A first of such third sets of indicia 32 representing such negative distance is disposed intermediate such first of such sets of indicia 26 representing such zero point and an outer edge of such first end of such gauging instrument 10 at a location closely adjacent such first of such sets of indicia 26 representing such zero point. A second of these third sets of indicia 32 representing such negative distance is disposed intermediate such second of such sets of indicia 26 representing the zero point and an outer edge of such axially opposed second end of such gauging instrument 10 at a location closely adjacent such second of the sets of indicia 26 representing such zero point. The third of such third sets of indicia 32 representing such negative distance will be disposed intermediate such third of the sets of indicia 26 representing such zero point and such second of the sets of indicia 26 representing such zero point at a location closely adjacent such third of such sets of indicia 26 representing such zero point.

In a still more preferred embodiment of the invention, such gauging instrument 10, for providing accurate alignment in a printing arrangement, includes between six and fifteen sets of indicia 30 representing such positive distance which are disposed at predetermined locations on such upper surface 28 of such flexible member 10. In addition, in this embodiment, such gauging instrument 10 includes between six and fifteen sets of indicia 32 representing such negative distance which are disposed at predetermined locations on such upper surface 28 of such flexible member 10. As illustrated in FIGS. 1 through 4, such second sets of indicia 30 are negative signs and such third sets of indicia 32 are positive signs. It should be noted that only second sets of indicia 30 have been shown in FIG. 4.

In one preferred alternative embodiment, there is provided a gauging instrument 10 for providing an accurate alignment in a printing arrangement between adjacent working surfaces 12 and 14, respectively, of an anilox roll 16 and a printing plate cylinder 18 and between adjacent working surfaces 14 and 20, respectively, of such printing plate cylinder 18 and an impression cylinder 22. Such gauging instrument 10 enables parallelism to be established between such adjacent working surfaces 12 and 14 of such anilox roll 16 and such printing plate cylinder 18 and between such adjacent working surfaces 14 and 20 of such printing plate cylinder 18 and such impression cylinder 22 in each print station of such printing arrangement. This gauging instrument includes a plurality of predetermined generally flexible members 10. Each such flexible member 10 having a predetermined length, a predetermined width and a first predetermined thickness. The back surface 24 of each flexible member 10 being engageable with such outer working surface 14 of such printing plate cylinder 18. There is a like plurality of first sets of indicia 26 representing a zero point between such impression cylinder 22 and such printing plate cylinder 18. Each such flexible member 10 having a first set of indicia 26 disposed on the upper surface 28 thereof substantially midway between axially opposed ends thereof. These first sets of indicia 26 have a second predetermined thickness Further, there is a predetermined plurality of second sets of indicia 30 which represent a positive distance a gap established between such impression cylinder 22 and such printing plate cylinder 18 is from such zero point. At least one second set of indicia 30 is disposed on such upper surface 28 of each such flexible member 10 at a predetermined location intermediate a first predetermined end thereof and such first set of indicia 26. Such second set of indicia 30 having a third predetermined thickness. Finally, in this embodiment of the invention, there is a predetermined plurality of third sets of indicia 32 representing a negative distance such gap established between such impression cylinder 22 and such printing plate cylinder 18 is from such zero point. At least one third set of indicia 32 is disposed on such upper surface 28 of each such flexible member 10 at a predetermined location intermediate an axially opposed second end thereof and such first set of indicia 26. Such third set of indicia 32 having a fourth predetermined thickness.

In one form of this embodiment, such each flexible member 10 will further include a magnetic backing member disposed on such back surface 24 thereof for holding such gauging instrument 10 in place on such working surface 14 of such printing plate cylinder 18.

In such gauging instrument 10 such predetermined plurality of such first sets of indicia 30 and such predetermined plurality of such second sets of indicia 30 and such predetermined plurality of such third sets of indicia 32 will preferably be flexible.

In addition, it is preferred in such gauging instrument, one of such plurality of flexible members 10 and one of such plurality of first sets of indicia 26 and at least one of such plurality of second sets of indicia 30 and at least one of such plurality of third sets of indicia 32 will be molded as a single piece unit.

Such gauging instrument 10, in the most preferred embodiment includes three flexible members 10. Such back surface 24 of a first of these three flexible members 10 being engageable with a first end of such working surface 14 of such printing plate cylinder 18. The back surface 24 of a second of such three flexible members 10 being engageable with an axially opposed second end of such working surface 14 of such printing plate cylinder 18 and the back surface 24 of a third of such three flexible members 10 being engageable with such working surface 14 of such printing plate cylinder 18 substantially midway between such first and such second of such three flexible members 10.

In this embodiment, the gauging instrument 10 for providing accurate alignment in a printing arrangement will have three flexible members 10. Each such flexible member 10 includes from 1 to 5 of such second sets of indicia 30 representing such positive distance.

Additionally, in this embodiment, each of such three flexible members 10 will preferably include between 3 and 5 of such second sets of indicia 30 representing such positive distance and each of such second sets of indicia 30 will be spaced substantially equidistant from one another. Also, in this embodiment, each of such three flexible members 10 will include from at least 1 to about 5 of such third sets of indicia 32 representing such negative distance. More preferably, each of such three flexible members 10 will include between 3 and 5 of such third set of indicia 32 representing such negative distance and each of such third sets of indicia 32 will be spaced substantially equidistant from one another. Furthermore, such second sets of indicia 30 will be negative signs and such third sets of indicia 32 will be positive signs in this arrangement of the invention.

The present invention further provides a method of establishing parallelism between the adjacent working surfaces 12 and 14 of such anilox roll 16 and such printing plate cylinder 18, in addition to between such working surfaces 14 and 20 of such printing plate cylinder 18 and the impression cylinder 22 in a printing arrangement. Such method includes the steps of: (1) opening a first print station disposed in such printing arrangement; (2) positioning a back surface 24 of at least one gauging instrument 10, having a plurality of predetermined markings 26, 30 and 32 disposed on an opposed outer surface 28 thereof, on a working surface 14 of such printing plate cylinder 18 in a position such that certain selected markings located adjacent each end of such gauging instrument 10 are toward each other; (3) adjusting such anilox roll 16 until a working surface 12 thereof makes contact with at least a portion of such plurality of markings 26, 30 and 32 on such outer surface 28 of such gauging instrument 10 so that inking of such at least a portion of such plurality of markings 26, 30 and 32 will be achieved; (4) comparing readings on such plurality of markings 26, 30 and 32 to determine if inking achieved in step (3) is occurring substantially equal across such printing plate cylinder 18; (5) indicating by such predetermined markings 26, 30 and 32 a degree to which such adjacent working surface 12 of such anilox roll 16 and such working surface 14 of such printing plate cylinder 18 are out of parallelism when it is determined in step (4) that such inking achieved in step (3) is not substantially equal across such printing plate cylinder 18; (6) making necessary adjustments indicated in step (5) to establish parallelism between the adjacent working surfaces 12 and 14, respectively, of such anilox roll 16 and such printing plate cylinder 18; (7) cleaning such gauging instrument 10; (8) repeating steps (5) through (7) until such inking is substantially equal across such printing plate cylinder 18; (9) repeating step (7) once such inking is substantially equal across the printing plate cylinder 18; (10) inking such gauging instrument 10; (11) increasing impression of such impression cylinder 16 with such printing plate cylinder 18 at least until contact is achieved between at least a portion of such plurality of markings 26, 30 and 32 on such outer surface 28 of such gauging instrument 10 and one of such working surface 20 of the impression cylinder 22 and a surface (not shown) of a substrate material (not shown); (12) transferring ink readings from such gauging instrument 10 to such one of such working surface 20 of such impression cylinder 22 and such surface of such substrate material; (13) comparing ink readings transferred in step (12) to determine if inking is occurring substantially at a same degree across such one of such working surface 20 of such impression cylinder 22 and such surface of such substrate material; (14) indicating by such predetermined markings 26, 30 and 32, a degree to which such adjacent working surfaces 20 and 14 of such impression cylinder 22 and such printing plate cylinder 18, respectively, are out of parallelism when it is determined in step (13) that such ink reading transferred in step (12) is not substantially equal across such one of such working surface 20 of such impression cylinder 22 and such surface of the substrate material; (15) making necessary adjustments indicated in step (14) when such ink readings are not substantially equal; (16) repeating steps (9) through (15) until such ink readings are substantially equal; and (17) repeating steps (1) through (16) for each print station in such printing arrangement.

In a more preferred embodiment of the present invention, such method includes the additional step of simultaneously establishing a zero point between such working surfaces 12 and 14 of such anilox roll 16 and such printing plate cylinder 18 and between such printing plate cylinder 18 and such impression cylinder 22 thereby determining a true impression in such printing arrangement.

According to the method of establishing parallelism between working surfaces in a printing arrangement, such predetermined markings 26, 30 and 32 include at least two sets of 0.000 marks 26. One set of such 0.000 marks 26 being located substantially adjacent each end of such gauging instrument 10 and such method of establishing such zero point includes the steps of: (1) referring to said 0.000 mark 26 on such gauging instrument 10; (2) increasing impression on such anilox roll 16 to such printing plate cylinder 18 until such 0.000 marks 26 are inked; and (3) setting press indicators (not shown) accordingly.

In this embodiment, such predetermined markings 30 and 32 include each of positive signs and negative signs.

In this method of establishing parallelism between working surfaces in a printing arrangement, at least two substantially identical gauging instruments 10 will be used and such method includes the step of placing one of such gauging instruments 10 on a working surface 14 substantially adjacent each end of such printing plate cylinder 18 such that such positive signs disposed on the upper surface 28 of each of such gauging instruments 10 are positioned facing each other.

Such method includes, in a more preferred embodiment, the additional step of placing a third substantially identical gauging instrument 10 on such working surface 14 of the printing plate cylinder 18 intermediate such at least two gauging instruments 10.

In this case, such positive signs on such third gauging instrument 10 will be positioned facing such positive signs positioned on a left side of such printing plate cylinder 18. Preferably, each of such gauging instruments 10 will include an equal number of positive signs and negative signs.

Furthermore, such method preferably includes the additional step of cleaning such gauging instrument 10 after each print station disposed in such printing arrangement has been adjusted. Such cleaning includes the steps of: (1) washing such gauging instrument 10 with a mild detergent; (2) rinsing such detergent off such gauging instrument 10; and (3) blowing excess moisture off such gauging instrument 10 with air.

It is further preferred that, prior to starting, such method of establishing parallelism between working surfaces in a printing arrangement includes the additional steps of: (1) checking an ink supply reservoir (not shown) for fiber residue; and (2) cleaning such ink supply reservoir when excess fiber residue is present.

In addition, such method preferably, prior to starting, includes the additional steps of: (1) checking such anilox roll 16 for detrimental contamination; and (2) cleaning such anilox roll 16 when such contamination is present.

Such method of establishing parallelism between working surfaces in a printing arrangement, according to the preferred embodiment of the invention, includes, prior to starting, the additional steps of: (1) checking the printing plate cylinder 18 for possible contamination; and (2) cleaning such printing plate cylinder 18 when such contamination is present.

It is obvious also that such method of establishing parallelism between working surfaces in a printing arrangement, prior to starting, includes the additional step of supplying ink to each inking fountain (not shown) in such print station and that the setting ink viscosity is desirable. Normally, about 2 points will separate such ink viscosity at each print station. Preferably, such ink viscosity at a first station will be set at about 19 points and such ink viscosity at a last station will be set at about 26 points.

Finally, the method of establishing parallelism between working surface in a printing arrangement, prior to starting, includes the additional steps of: (1) checking such gauging instrument 10 for possible contamination; and (2) cleaning such gauging instrument 10 when any contamination is present.

Figure 6:
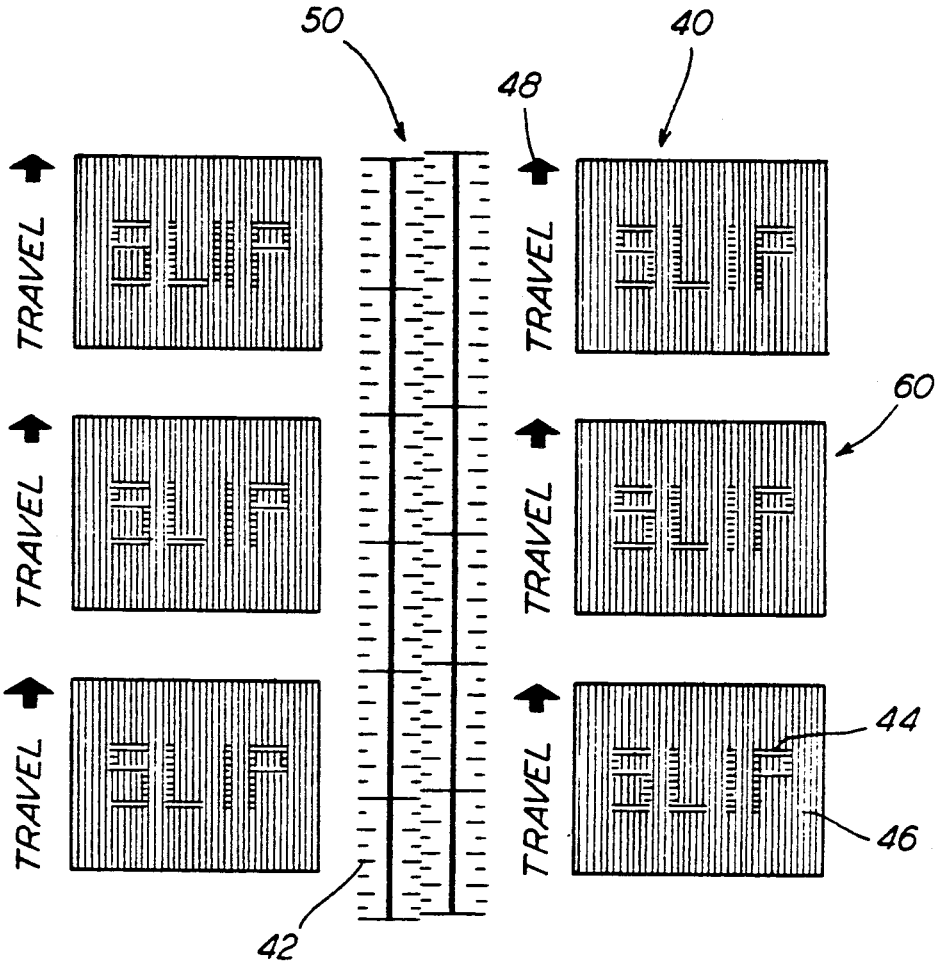
FIG. 6 is a front view which illustrates a sync scale printing instrument for synchronizing speed of a printing plate speed to a substrate speed.

The present invention, in another aspect thereof, which is illustrated in FIG. 6 provides a speed synchronization apparatus, generally designated 40, for ensuring substantial synchronization of a rotational speed of a working surface 14 of a printing plate cylinder 18 with a linear speed of a substrate surface (not shown) which is to receive printed matter thereon in a printing arrangement. Such speed synchronization apparatus 40 comprises at least one printing instrument member, generally designated 50, having a back surface thereof (not shown) engageable with such working surface 14 of such printing plate cylinder 18 disposed in such printing arrangement. This printing instrument member 50 includes a predetermined number of predetermined indicia 42 disposed on an upper surface thereof which are positioned at predetermined locations for determining both when slippage occurs and where such slippage occurs during operation of such printing arrangement.

Such speed synchronization apparatus 40 further includes at least one line screen member, generally designated 60, having a back surface thereof (not shown) engageable with such working surface 14 of such printing plate cylinder 18 disposed in such printing arrangement. This line screen member 60 having a predetermined number of substantially horizontal lines 44 which create on such substrate surface at least one predetermined character and a predetermined number of substantially vertical lines 46 which create a background for such predetermined character on such substrate surface. Such line screen member 60 will enable a determination to be made of at least one of such substrate surface travelling at a greater rate of speed than such printing plate cylinder 18 and such printing plate cylinder 18 travelling at a greater rate of speed than such substrate surface.

In one embodiment of the speed synchronization apparatus 40, such preselected indicia is a plurality of arrows 48, which are positioned adjacent at least one outer edge portion of such printing instrument member 50. It is preferred that such arrows are spaced equally along such outer edge portion of such printing instrument member 50 and that such arrows are spaced on or about one-inch centers.

It is equally preferred that such line screen member 60 forms repeating predetermined geometrics and that such repeating predetermined geometrics are substantially rectangular boxes.

In the preferred speed synchronization apparatus 40, such predetermined character will be at least one letter and both such printing instrument member 50 and such line screen member 60 will have a curved shape.

The present invention further provides a method of synchronizing a rotational speed of a working surface 14 of a printing plate cylinder 18 with a linear speed of a substrate surface (not shown) which is to receive printed matter thereon in a printing arrangement. This method comprises the steps of: (1) Positioning a printing instrument sync scale member 40 on the working surface 14 of such printing plate cylinder 18 which is disposed in a print station (not shown) of such printing arrangement. Such printing instrument sync scale member 40 having a predetermined number of substantially equally spaced arrows 48 positioned adjacent at least one outer edge portion thereof. (2) Feeding a substrate material through such print station in said printing arrangement. (3) Printing such arrows 48 on a surface of such substrate material simultaneously while feeding it through such printing arrangement in step (2). (4) Measuring a distance between each arrow printed on such surface of such substrate material in step (3) to determine both if slippage occurred and where slippage occurred. (5) Making necessary adjustments in such printing arrangement to eliminate such slippage. (6) Repeating steps (2) through (5) until all such slippage has been eliminated. (7) Removing such printing instrument sync scale member 50 from such working surface 14 of such printing plate cylinder 18. (8) Positioning a line screen sync scale member 60 on such working surface 14 of such printing plate cylinder 18. Such line screen sync scale member 60 having a plurality of substantially horizontal lines 44 which create at least one predetermined character on the surface of such substrate material and a plurality of substantially vertical lines 46 which create a background for such predetermined character on such surface of such substrate material. (9) Feeding such substrate material through such printing arrangement. (10) Printing such plurality of horizontal lines 44 and such plurality of vertical lines 46 on such surface of such substrate material simultaneously while feeding it through such printing arrangement in step (9). (11) Observing an image printed on such surface of such substrate material in step (10). (12) Determining from such image observed in step (11) when at least one of such substrate material is travelling faster than such printing plate cylinder 18 and such printing plate cylinder 18 is travelling faster than such substrate material. (13) Making necessary adjustments in such printing arrangement to synchronize such rotational speed of the printing plate cylinder 18 with the linear speed of such substrate material. (14) Repeating steps (12) and (13) until substantial synchronization of such rotational speed of such printing plate cylinder 18 and such linear speed of such substrate material is achieved. (15) Removing such line screen sync scale member 60 from such printing plate cylinder 18. And (16) repeating steps (1) through (15) for each print station in such printing arrangement.

Figure 5:
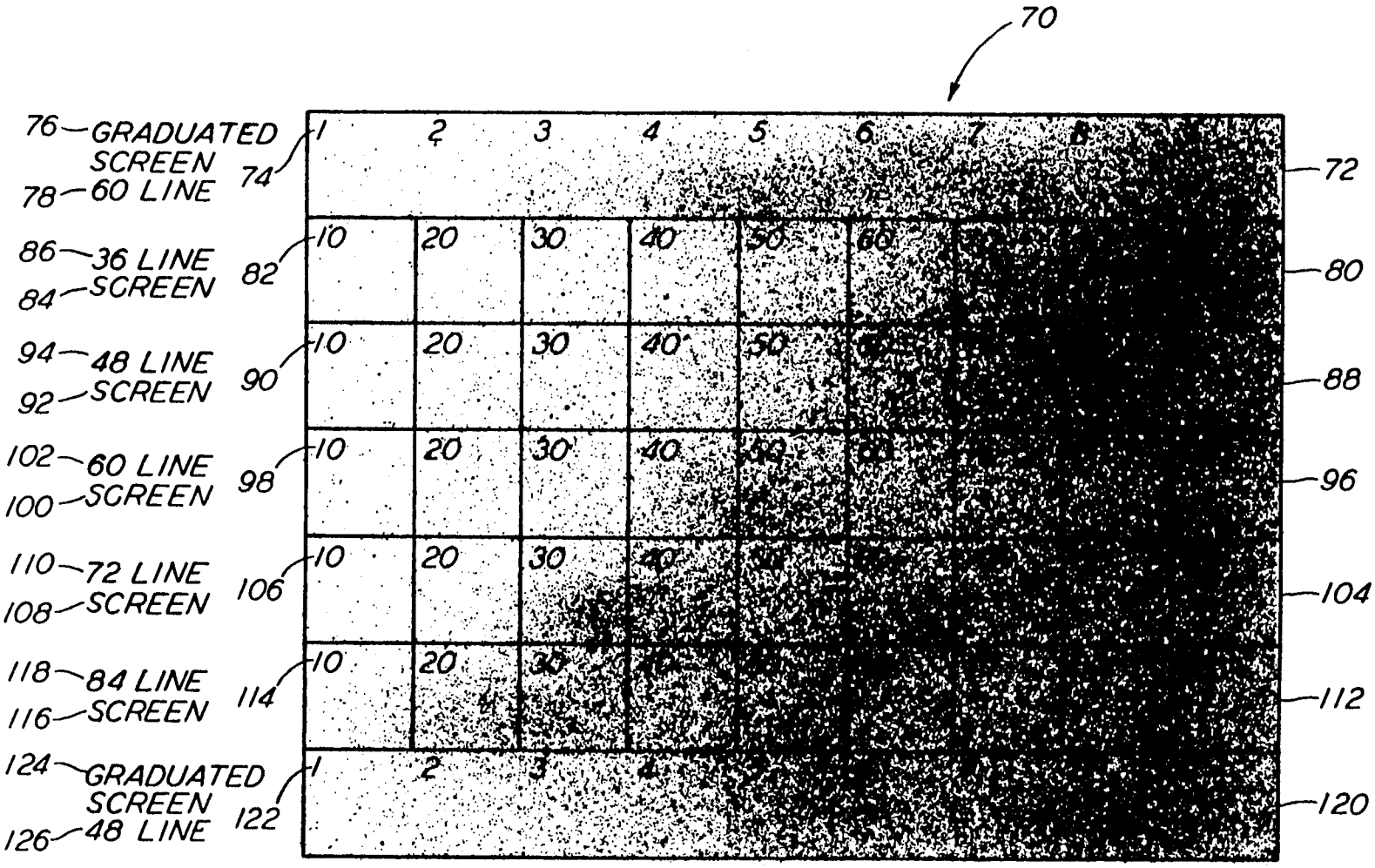
FIG. 5 is a front view which illustrates a report card type printing instrument.

Reference is now made to FIG. 5. Illustrated therein, is a printing instrument, generally designated 70, useful in a printing arrangement for printing on at least a portion of a preselected substrate material a report card that will provide substantially precise documentation of at least each of preselected screen values and a percentage of an image maintained by a particular print station disposed in such printing arrangement. Such printing instrument 70 comprises a first printing member 72 having each of a first predetermined width and a first predetermined length and a first predetermined thickness. A back surface (not shown) of such first printing member 72 being engageable with and securable to a working surface 14 of a printing plate cylinder 18 disposed in such print station of such printing arrangement. Such first printing member 72 having a first set of indicia 74 arranged on an axially opposed upper surface thereof, which when printed on a surface of such substrate material will indicate across a predetermined width thereof graduated screen values 76 of a first preselected line value 78 and such percentage of such image maintained by such print station at such first preselected line value 78.

Such printing instrument 70 further includes a second printing member 80 having each of a second predetermined width and a second predetermined length and a second predetermined thickness, a first elongated edge of said second printing member 80 being disposed adjacent a first elongated edge of said first printing member 72. A back surface of such second printing member 80 being engageable with and securable to such working surface 14 of such printing plate cylinder 18. Such second printing member 80 having a second set of indicia 82 arranged on an axially opposed upper surface thereof, which when printed on such surface of such substrate material will indicate across a predetermined width thereof screen values 84 of a second preselected line value 86 and such percentage of such image maintained by such print station at such second preselected line value 86.

Such printing instrument 70, in a more preferred embodiment, further includes a third printing member 88 having each of a third predetermined width and a third predetermined length and a third predetermined thickness. A first elongated edge of such third printing member 88 being disposed adjacent a second elongated edge of second printing member 80. A back surface of such third printing member 88 being engageable with and securable to such working surface 14 of such printing plate cylinder 18. Such third printing plate member 88 having a third set of indicia 90 arranged on an axially opposed upper surface thereof, which when printed on such surface of such substrate material will indicate across a predetermined width thereof screen values 92 of a third preselected line value 94 and such percentage of such image maintained by such print station at such third preselected line value 94.

The printing instrument 70, further includes, in a still more preferred embodiment, a fourth printing member 96 having each of a fourth predetermined width and a fourth predetermined length and a fourth predetermined thickness. A first elongated edge of such fourth printing member 96 being disposed adjacent a second elongated edge of such third printing member 88. A back surface of such fourth printing member 96 also being engageable with and securable to such working surface 14 of such printing plate cylinder 18. Such fourth printing plate member 96 having a fourth set of indicia 98 arranged on an axially opposed upper surface thereof, which when printed on such surface of such substrate material will indicate across a predetermined width thereof screen values 100 of a fourth preselected line value 102 and such percentage of such image maintained by such print station at such fourth preselected line value 102.

Such printing instrument 70 can further include a fifth printing member 104 having each of a fifth predetermined width and a fifth predetermined length and a fifth predetermined thickness. A first elongated edge of such fifth printing member 104 being disposed adjacent a second elongated edge of such fourth printing member 96. A back surface of such fifth printing member 104 also being engageable with and securable to such working surface 14 of such printing plate cylinder 18. This fifth printing plate member 104 having a fifth set of indicia 106 arranged on an axially opposed upper surface thereof, which when printed on such surface of such substrate material will indicate across a predetermined width thereof screen values 108 of a fifth preselected line value 110 and such percentage of such image maintained by such print station at such fifth preselected line value 110.

Preferably, such printing instrument 70 will further include a sixth printing member 112 having each of a sixth predetermined width and a sixth predetermined length and a sixth predetermined thickness. A first elongated edge of such sixth printing member 112 being disposed adjacent a second elongated edge of such fifth printing member 104. The back surface of such sixth printing member 112 being engageable with and securable to such working surface 14 of such printing plate cylinder 18. This sixth printing plate member 112 has a sixth set of indicia 114 arranged on an axially opposed upper surface thereof, which when printed on such surface of such substrate material will indicate across a predetermined width thereof screen values 116 of a sixth preselected line value 118 and such percentage of such image maintained by such print station at such sixth preselected line value 118.

In the most preferred printing instrument 70, there is a seventh printing member 120 having each of a seventh predetermined width and a seventh predetermined length and a seventh predetermined thickness. A first elongated edge of such seventh printing member 120 being disposed adjacent a second elongated edge of such sixth printing member 112. The back surface of such seventh printing member 120 being engageable with and securable to such working surface 14 of such printing plate cylinder 18. Such seventh printing plate member 120 having a seventh set of indicia 122 arranged on an axially opposed upper surface thereof, which when printed on such surface of such substrate material will indicate across a predetermined width thereof graduated screen values 124 of a seventh preselected line value 126 and such percentage of such image maintained by such print station at such seventh preselected line value 126.

Such printing instrument 70 containing each of such first 72, second 80, third 88, fourth 96, fifth 104, sixth 112 and seventh printing member 120 is preferably formed as a single piece. Such graduated screen values 76 and 124 will preferably be 48 lines and 60 lines as shown in FIG. 5, and such screen values are 36 lines, 48 lines, 60 lines, 72 lines and 84 lines, also as shown in FIG. 5.

In the printing instrument 70, such predetermined length and such predetermined width of each of such printing members will be substantially identical.

This invention also teaches a method of providing substantially precise documentation of a plurality of preselected screen values and a percent of an image maintained by a particular printing arrangement. Such method comprises the steps of: (1) Establishing parallelism between an anilox roll 16 and a printing plate cylinder 18 disposed in a print station located in said printing arrangement and between such printing plate cylinder 18 and an impression cylinder 18. (2) Establishing synchronization of a rotational speed of such printing plate cylinder 18 with a linear speed of a surface of substrate material to be printed thereon. (3) Mounting a printing instrument 70 on a working surface 14 of such printing plate cylinder 18 which will print on the surface of such substrate material a report card which when printed on such surface of the substrate material is capable of providing such precise documentation of such preselected screen values and such percent of such image maintained. (4) Ensuring a predetermined printing instrument 70 impression to such anilox roll 16. (5) Disengaging all print stations in such printing arrangement not being used. (6) Moving such substrate material through such printing arrangement. (7) Inspecting the resulting printed sheet. (8) Adjusting such print station as required based on inspection of such printed sheet in step (7). (9) Repeating steps (4) through (8) until such printed sheet meets specified requirements for a particular job. (10) Documenting at least some print statistics obtained in step (9). (11) Washing such printing instrument 70 while still mounted on such printing plate cylinder 18. (12) Rinsing such printing instrument 70 while still mounted on such printing plate cylinder 18. (13) Drying such printing instrument 70 while still mounted on such printing plate cylinder 18. (14) Repeating steps (1) through (13) for each print station to be used on a particular job. (15) Repeating steps (11) through (14) after a final print station has been adjusted. And (16) removing such printing instrument 70 from such printing plate cylinder 18.

Figure 7:
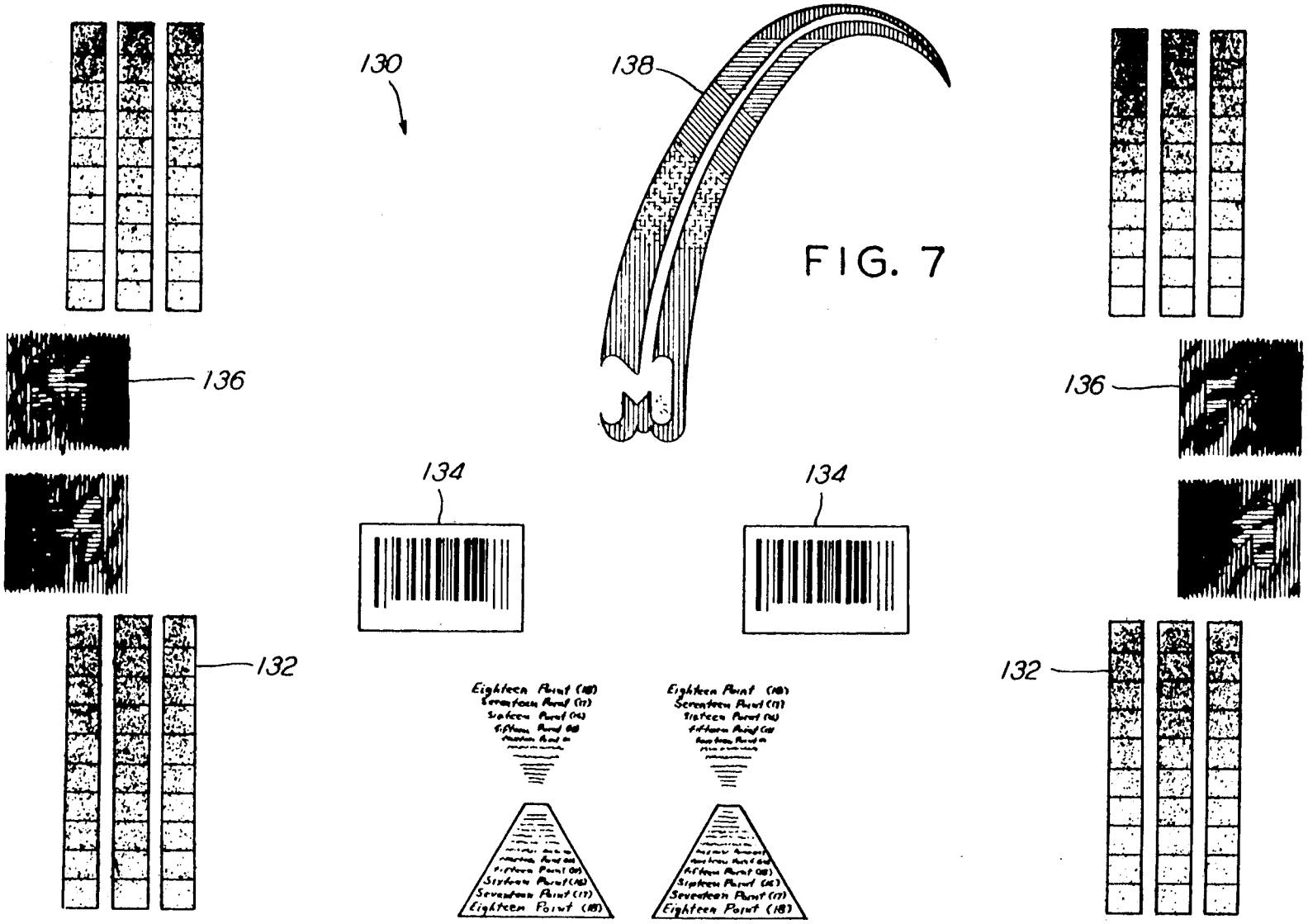
FIG. 7 is a front view of a printing instrument which provides enhanced capabilities in setting up a printing arrangement.

Reference is now drawn to FIG. 7, wherein there is illustrated a printing arrangement diagnostic testing instrument, generally designated 130, having preselected components for evaluating preselected print characteristics. Such diagnostic testing instrument 130 includes at least one printing instrument means 132 for evaluating a plurality of preselected screen values. In addition, there is provided at least one printing instrument means 134 for evaluating bar codes on such testing instrument 130. Further, such testing instrument 130 includes at least one printing instrument means for evaluating impression. Also provided by this testing instrument 130 is at least one printing instrument means 136 for evaluating slippage; and at least one printing instrument means 138 for evaluating distortion.

In total, the present invention provides an enhanced print analysis system which provides enhanced print quality in a package-type printing system. Such print analysis system comprises at least one gauge means engageable with at least a portion of a working surface of a printing plate cylinder for establishing parallelism between a working surface of an anilox roll and such working surface of such printing plate cylinder and between a working surface of an impression cylinder and such working surface of such printing plate cylinder and for simultaneously establishing a zero point between such working surfaces of such anilox roll and such printing plate cylinder and between a working surface of an impression cylinder and such working surface of such printing plate cylinder and for simultaneously establishing a zero point between such working surfaces of such anilox roll and such printing plate cylinder and between such working surfaces of such impression cylinder and such printing plate cylinder.

Further, such print analysis system includes a speed synchronization means engageable with at least a portion of such working surfaces of such printing plate cylinder for substantially synchronizing a rotational speed of such working surface of such printing plate cylinder with a feeding speed of a substrate surface to be printed in such package-type printing system.

A documentation means engageable with at leas a portion of such working surface of such printing plate cylinder is provided in the print analysis system for providing documentation of at least one of screen value and a percent image that is maintained by at least one individual print station in such package-type printing system; and a print characteristic evaluation means engageable with at least a portion of such working surface of such printing plate cylinder for evaluating print characteristics of at least one of positive screens, reverse graduated-type screens, bar codes, solids, impressions, slippage and distortion and for printing a multi-color process graphic which can be analyzed to ensure maintenance of peak point performance in such package-type printing system.

We claim:

1. A gauging instrument for providing an accurate alignment in a printing arrangement between adjacent working surfaces of an anilox roll and a printing plate cylinder and between adjacent working surfaces of such printing plate cylinder and an impression cylinder so that substantial parallelism can be established between such adjacent working surfaces of such anilox roll and such printing plate cylinder and such adjacent working surfaces of such printing plate cylinder and such impression cylinder in each print station disposed in such printing arrangement, said gauging instrument comprising:

(a) at least one generally flexible member having a predetermined length, a predetermined width and a first predetermined thickness, a back surface of said flexible member being engageable with at least a portion of an outer working surface of such printing plate cylinder;

(b) at least two first sets of indicia, disposed at predetermined locations on an upper surface of said flexible member, representing a zero point of a gap established between such impression cylinder and such printing plate cylinder, said first sets of indicia having a second predetermined thickness;

(c) at least two second sets of indicia, disposed at predetermined locations of said upper surface of said flexible member, said second sets of indicia representing a positive distance such gap established between such impression cylinder and such printing plate cylinder is from said zero point, said second sets of indicia having a third predetermined thickness; and (d) at least two third sets of indicia, disposed at predetermined locations on said upper surface of said flexible member, said third sets of indicia representing a negative distance such gap established between such impression cylinder and such printing plate cylinder is from said zero point, said third sets of indicia having a fourth predetermined thickness.

2. A gauging instrument for providing accurate alignment in a printing arrangement, according to claim 1, wherein said gauging instrument further includes a magnetic backing member disposed on said back surface of said flexible member for holding said gauging instrument in place on such working surface of such printing plate cylinder.

3. A gauging instrument for providing accurate alignment in a printing arrangement, according to claim 2, wherein said flexible member and said first sets of indicia and said second sets of indicia and said third sets of indicia are molded as a single piece unit.

4. A gauging instrument for providing accurate alignment in a printing arrangement, according to claim 1, wherein said gauging instrument includes three first sets of indicia representing said zero point, a first of said sets of indicia representing said zero point disposed adjacent a first end of said gauging instrument, a second of said first sets of indicia representing said zero point disposed adjacent an axially opposed second end of said gauging instrument and a third of said first sets of indicia representing said zero point disposed substantially midway between said first of said first sets and said second of said first sets of indicia representing said zero point.

5. A gauging instrument for providing accurate alignment in a printing arrangement, according to claim 4, wherein said gauging instrument includes at least three second sets of indicia representing said positive distance, a first of said second sets of indicia representing said positive distance disposed intermediate said first of said first sets of indicia representing said zero point and said third of said first sets of indicia representing said zero point at a location closely adjacent said first of said first sets of indicia representing said zero point, a second of said second sets of indicia representing said positive distance disposed intermediate said second of said first sets of indicia representing said zero point and said third of first said sets of indicia representing said zero point at a location closely adjacent said second of said first sets of indicia representing said zero point and a third of said second sets of indicia representing said positive distance disposed intermediate said first of said first sets of indicia representing said zero point and said third of said first sets of indicia representing said zero point at a location closely adjacent said third of said first sets of indicia representing said zero point.

6. A gauging instrument for providing accurate alignment in a printing arrangement, according to claim 6, wherein said gauging instrument includes at least three third sets of indicia representing said negative distance, a first of said third sets of indicia representing said negative distance disposed intermediate said first of said first sets of indicia representing said zero point and an outer edge of said first end of said gauging instrument at a location closely adjacent said first of said first sets of indicia representing said zero point, a second of said third sets of indicia representing said negative distance disposed intermediate said second of said first sets of indicia representing said zero point and an outer edge of said axially opposed second end of said gauging instrument at a location closely adjacent said second of said first sets of indicia representing said zero point, a third of said third sets of indicia representing said negative distance disposed intermediate said third of said first sets of indicia representing said zero point and said second of said first sets of indicia representing said zero point at a location closely adjacent said third of said first sets of indicia representing said zero point.

7. A gauging instrument for providing an accurate alignment in a printing arrangement between adjacent working surfaces of an anilox roll and a printing plate cylinder and between adjacent working surfaces of such printing plate cylinder and an impression cylinder so that substantial parallelism can be established between such adjacent working surfaces of such anilox roll and such printing plate cylinder and between such adjacent working surfaces of such printing plate cylinder and such impression cylinder in each print station of such printing arrangement, said gauging instrument comprising:

(a) a plurality of generally flexible members, each flexible member having a predetermined length, a predetermined width and a first predetermined thickness, a back surface of said each flexible member being engageable with an outer working surface of such printing plate cylinder;

(b) a plurality of first sets of indicia representing a zero point between such impression cylinder and such printing plate cylinder, said each flexible member having a first set of indicia disposed on an upper surface thereof substantially midway between axially opposed ends thereof, said first sets of indicia having a second predetermined thickness;

(c) a plurality of second sets of indicia representing a positive distance a gap established between such impression cylinder and such printing plate cylinder is from such zero point, at least one second set of indicia is disposed on said upper surface of said each flexible member at a predetermined location intermediate a first predetermined end thereof and said first set of indicia, said second set of indicia having a third predetermined thickness; and (d) a plurality of third sets of indicia representing a negative distance such gap established between such impression cylinder and such printing plate cylinder is from such zero point, at least one third set of indicia is disposed on said upper surface of said each flexible member at a predetermined location intermediate an axially opposed second end thereof and said first set of indicia, said third set of indicia having a fourth predetermined thickness.

8. A gauging instrument for providing accurate alignment in a printing arrangement, according to claim 7, wherein said plurality of said first sets of indicia and said plurality of said second sets of indicia and said plurality of said third sets of indicia are flexible.

9. A gauging instrument for providing accurate alignment in a printing arrangement, according to claim 7, wherein said gauging instrument includes three flexible members, said back surface of a first of said three flexible members being engageable with a first end of such working surface of such printing plate cylinder, said back surface of a second of said three flexible members being engageable with an axially opposed second end of such working surface of such printing plate cylinder and said back surface of a third of said three flexible members being engageable with such working surface of such printing plate cylinder substantially midway between said first and said second of said three flexible members.

10. A gauging instrument for providing accurate alignment in a printing arrangement, according to claim 9, wherein each of said three flexible members includes from 1 to 5 of said second sets of indicia representing said positive distance.

11. A gauging instrument for providing accurate alignment in a printing arrangement, according to claim 10, wherein said each of said three flexible members includes from 1 to 5 of said third sets of indicia representing said negative distance.

12. A gauging instrument for providing accurate alignment in a printing arrangement, according to claim 11, wherein said second sets of indicia are negative signs and said third sets of indicia are positive signs.

13. A method of establishing substantial parallelism between adjacent working surfaces of an anilox roll and printing plate cylinder in addition to between such printing plate cylinder and an impression cylinder in a printing arrangement, said method comprising the steps of:

(a) opening a first print station disposed in said printing arrangement;

(b) positioning a back surface of at least one gauging instrument, having a plurality of predetermined markings disposed on an opposed outer surface thereof, on a working surface of said printing plate cylinder in a position such that certain selected markings located adjacent each end of said gauging instrument are toward each other;

(c) adjusting said anilox roll until a working surface thereof makes contact with at least a portion of said plurality of markings on said outer surface of said gauging instrument so that inking of said at least a portion of said plurality of markings will be achieved;

(d) comparing readings on said plurality of markings to determine if inking achieved in step (c) is occurring substantially equal across said printing plate cylinder;

(e) indicating by said predetermined markings a degree to which said adjacent working surface of said anilox roll and said printing plate cylinder are out of parallelism when it is determined in step (d) that said inking achieved in step (c) is not substantially equal across said printing plate cylinder;

(f) making necessary adjustments indicated in step (e) to establish parallelism between said adjacent working surfaces of said anilox roll and said printing plate cylinder;

(g) cleaning said gauging instrument;

(h) repeating steps (e) through (g) until said inking is substantially equal across said printing plate cylinder;

(i) repeating step (g) once said inking is substantially equal across said printing plate cylinder;

(j) inking said gauging instrument;

(k) increasing impression of said impression cylinder with said printing plate cylinder at least until contact is achieved between at least a portion of said plurality of markings on said outer surface of said gauging instrument and one of said working surface of said impression cylinder and a surface of a substrate material;

(l) transferring ink readings from said gauging instrument to said one of said working surface of said impression cylinder and said surface of said substrate material;

(m) comparing ink readings transferred in step (l) to determine if inking is occurring substantially at a same degree across said one of said working surface of said impression cylinder and said surface of said substrate material;

(n) indicating by said predetermined markings a degree to which said adjacent working surfaces of said impression cylinder and said printing plate cylinder are out of parallelism when it is determined in step (m) that said ink reading transferred in step (l) is not substantially equal across said one of said working surface of said impression cylinder and said surface of said substrate material;

(o) making necessary adjustments indicated in step (n) when said ink readings are not substantially equal;

(p) repeating steps (i through o) until said ink readings are substantially equal; and (q) repeating steps (a through p) for each print station in said printing arrangement.

14. A method of establishing parallelism between working surfaces in a printing arrangement, according to claim 13, wherein said method includes the additional step of simultaneously establishing a zero point between said working surfaces of said anilox roll and said printing plate cylinder and between said printing plate cylinder and said impression cylinder thereby determining a true impression in said printing arrangement.

15. A method of establishing parallelism between working surfaces in a printing arrangement, according to claim 14, wherein said predetermined markings include at least two sets of 0.000 marks, one set of said 0.000 marks being located substantially adjacent each end of said gauging instrument and said method of establishing said zero point includes the steps of:

(a) referring to said 0.000 mark on said gauging instrument;

(b) increasing impression on said anilox roll to said printing plate cylinder until said 0.000 marks are inked; and (c) setting press indicators accordingly.

16. A method of establishing parallelism between working surfaces in a printing arrangement, according to claim 13, wherein at least two substantially identical gauging instruments are used and said method includes the step of placing one of said gauging instruments on a working surface substantially adjacent each end of said printing plate cylinder.

17. A method of establishing parallelism between working surfaces in a printing arrangement, according to claim 16, wherein said positive signs disposed on each of said gauging instruments are positioned facing each other.

18. A method of establishing parallelism between working surfaces in a printing arrangement, according to claim 17, wherein said method includes the additional step of placing a third substantially identical gauging instrument on said working surface of said printing plate cylinder intermediate said at least two gauging instruments.

19. A method of establishing parallelism between working surfaces in a printing arrangement, according to claim 18, wherein said positive signs on said third gauging instrument are positioned facing said positive signs positioned on a left side of said printing plate cylinder.

20. A method of establishing parallelism between working surfaces in a printing arrangement, according to claim 19, wherein said method includes the additional step of setting ink viscosity.

21. A method of establishing parallelism between working surfaces in a printing arrangement, according to claim 20, wherein about 2 points separate said ink viscosity at each print station.

22. A method of establishing parallelism between working surfaces in a printing arrangement, according to claim 21, wherein said ink viscosity at a first station is set at about 19 points.

23. A method of establishing parallelism between working surfaces in a printing arrangement, according to claim 22, wherein said ink viscosity at a last station is set at about 26 points.

24. A speed synchronization apparatus for ensuring substantial synchronization of a rotational speed of a working surface of a printing plate cylinder with a linear speed of a substrate surface which is to receive printed matter thereon in a printing arrangement, said speed synchronization apparatus comprising:

(a) at least one printing instrument member having a back surface thereof engageable with such working surface of such printing plate cylinder disposed in such printing arrangement, said printing instrument member having a predetermined number of predetermined indicia disposed on an upper surface thereof which are positioned at predetermined locations for determining both when slippage occurs and where such slippage occurs during operation of such printing arrangement; and (b) at least one line screen member having a back surface thereof engageable with such working surface of such printing plate cylinder disposed in such printing arrangement, said line screen member having a predetermined number of substantially horizontal lines which create on such substrate surface at least one predetermined character and a predetermined number of substantially vertical lines which create a background for said predetermined character on such substrate surface, said line screen member enabling a determination to be made of at least one of such substrate surface travelling at a greater rate of speed teen such printing plate cylinder and such printing plate cylinder travelling at a greater rate of speed than such substrate surface.

25. A speed synchronization apparatus, according to claim 24, wherein said preselected indicia is a plurality of arrows.

26. A speed synchronization apparatus, according to claim 25, wherein said arrows are positioned adjacent at least one outer edge portion of said printing instrument member.

27. A speed synchronization apparatus, according to claim 26, wherein said arrows are spaced equally along said outer edge portion of said printing instrument member.

28. A speed synchronization apparatus, according to claim 24, wherein said line screen member forms repeating predetermined geometrics.

29. A speed synchronization apparatus, according to claim 28, wherein said repeating predetermined geometrics are substantially rectangular boxes.

30. A speed synchronization apparatus, according to claim 29, wherein said predetermined character is at least one letter.

31. A method of synchronizing a rotational speed of a working surface of a printing plate cylinder with a linear speed of a substrate surface which is to receive printed matter thereon in a printing arrangement, said method comprising the steps of:

(a) positioning a printing instrument sync scale member on a working surface of a printing plate cylinder disposed in a print station of such printing arrangement, said sync scale member having a predetermined number of substantially equally spaced arrows positioned adjacent at least one outer edge portion thereof;

(b) feeding a substrate material through said print station in said printing arrangement;

(c) printing said arrows on a surface of said substrate material simultaneously while feeding it through said printing arrangement in step (b);

(d) measuring a distance between each arrow printed on said surface of said substrate material in step (c) to determine both if slippage occurred and where slippage occurred;

(e) making necessary adjustments in said printing arrangement to eliminate said slippage;

(f) repeating steps (b) through (e) until said slippage has been eliminated;

(g) removing said printing instrument sync scale member from said working surface of said printing plate cylinder;

(h) positioning a line screen sync scale member on said working surface of said printing plate cylinder, said line screen sync scale member having a plurality of substantially horizontal lines which create at least one predetermined character on said surface of said substrate material and a plurality of substantially vertical lines which create a background for said predetermined character on said surface of said substrate material;

(i) feeding said substrate material through said printing arrangement;

(j) printing said plurality of horizontal lines and said plurality of vertical lines on said surface of said substrate material simultaneously while feeding it through said printing arrangement in step (i);

(k) observing an image printed on said surface of said substrate material in step (j);

(l) determining from said image observed in step (k) when at least one of said substrate material is travelling faster than said printing plate cylinder and said printing plate cylinder is travelling faster than said substrate material;

(m) making necessary adjustments in said printing arrangement to synchronize said rotational speed of said printing plate cylinder with said linear speed of said substrate material;

(n) repeating steps (i) through (m) until substantial synchronization of said rotational speed of said printing plate cylinder and said substrate material is achieved;

(o) removing said line screen sync scale member from said printing plate cylinder; and (p) repeating steps (a through o) for each print station in said printing arrangement.

32. A printing instrument useful in a printing arrangement for printing on at least a portion of a preselected substrate material a report card that will provide substantially precise documentation of at least each of preselected screen values and a percentage of an image maintained by a particular print station disposed in such printing arrangement, said printing instrument comprising:

(a) a first printing member having each of a first predetermined width and a first predetermined length and a first predetermined thickness, a back surface of said first printing member being engageable with and securable to a working surface of a printing plate cylinder disposed in such print station of such printing arrangement, said first printing member having a first set of indicia arranged on an axially opposed upper surface thereof, which when printed on a surface of such substrate material will indicate across a predetermined width thereof graduated screen values of a first preselected line value and said percentage of said image maintained by such print station at said first predetermined line value; and (b) a second printing member having each of a second predetermined width and a second predetermined length and a second predetermined thickness, a first elongated edge of said second printing member being disposed adjacent a first elongated edge of said first printing member, a back surface of said second printing member being engageable with and securable to such working surface of such printing plate cylinder, said second printing member having a second set of indicia arranged on an axially opposed upper surface thereof, which when printed on such surface of such substrate material will indicate across a predetermined width thereof screen values of a second preselected line value and said percentage of said image maintained by such print station at said second preselected line value.

33. A printing instrument, according to claim 32, wherein said printing instrument further includes a third printing member having each of a third predetermined width and a third predetermined length and a third predetermined thickness, a first elongated edge of said third printing member being disposed adjacent a second elongated edge of said second printing member, a back surface of said third printing member being engageable with and securable to such working surface of such printing plate cylinder, said third printing plate member having a third set of indicia arranged on an axially opposed upper surface thereof, which when printed on such surface of such substrate material will indicate across a predetermined width thereof screen values of a third preselected line value and said percentage of said image maintained by such print station at said third preselected line value.

34. A printing instrument, according to claim 33, wherein said printing instrument further includes a fourth printing member having each of a fourth predetermined width and a fourth predetermined length and a fourth predetermined thickness, a first elongated edge of said fourth printing member being disposed adjacent a second elongated edge of said third printing member, a back surface of said fourth printing member being engageable with and securable to such working surface of such printing plate cylinder, said fourth printing member having a fourth set of indicia arranged on an axially opposed upper surface thereof, which when printed on such surface of such substrate material will indicate across a predetermined width thereof screen values of a fourth preselected line value and said percentage of said image maintained by such print station at said fourth preselected line value.

35. A printing instrument, according to claim 34, wherein said printing instrument further includes a fifth printing member having each of a fifth predetermined width and a fifth predetermined length and a fifth predetermined thickness, a first elongated edge of said fifth printing member being disposed adjacent a second elongated edge of said fourth printing member, a back surface of said fifth printing member being engageable with and securable to such working surface of such printing plate cylinder, said fifth printing member having a fifth set of indicia arranged on an axially opposed upper surface thereof, which when printed on such surface of such substrate material will indicate across a predetermined width thereof screen values of a fifth preselected line value and said percentage of said image maintained by such print station at said fifth preselected line value.

36. A printing instrument, according to claim 35, wherein said printing instrument further includes a sixth printing member having each of a sixth predetermined width and a sixth predetermined length and a sixth predetermined thickness, a first elongated edge of said sixth printing member being disposed adjacent a second elongated edge of said fifth printing member, a back surface of said sixth printing member being engageable with and securable to such working surface of such printing plate cylinder, said sixth printing member having a sixth set of indicia arranged on an axially opposed upper surface thereof, which when printed on such surface of such substrate material will indicate across a predetermined width thereof screen values of a sixth preselected line value and said percentage of said image maintained by such print station at said sixth preselected line value.

37. A printing instrument, according to claim 36, wherein said printing instrument further includes a seventh printing member having each of a seventh predetermined width and a seventh predetermined length and a seventh predetermined thickness, a first elongated edge of said seventh printing member being disposed adjacent a second elongated edge of said sixth printing member, a back surface of said seventh printing member being engageable with and securable to such working surface of such printing plate cylinder, said seventh printing member having a seventh set of indicia arranged on an axially opposed upper surface thereof, which when printed on such surface of such substrate material will indicate across a predetermined width thereof graduated screen values of a seventh preselected line value and said percentage of said image maintained by such print station at said seventh preselected line value.

38. A printing instrument, according to claim 37, wherein said printing instrument containing each of said first, second, third, fourth, fifth, sixth and seventh printing members is formed as a single piece.

39. A printing instrument, according to claim 38, wherein said predetermined length and said predetermined width of each of said printing members are substantially identical.

40. A method of providing substantially precise documentation of a plurality of preselected screen values and a percent of an image maintained by a particular printing arrangement, said method comprising the steps of:

(a) establishing parallelism between an anilox roll and a printing plate cylinder disposed in a print station located in said printing arrangement and between such printing plate cylinder and an impression cylinder;

(b) establishing synchronization of a rotational speed of said printing plate cylinder with a linear speed of a surface of substrate material to be printed thereon;

(c) mounting a printing instrument on a working surface of said printing plate cylinder which will print on said surface of said substrate material a report card which when printed on said surface of said substrate material is capable of providing said precise documentation of said preselected screen values and said percent of said image maintained;

(d) ensuring a predetermined printing instrument impression to said anilox roll;

(e) disengaging all print stations in said printing arrangement not being used;

(f) moving said substrate material through said printing arrangement;

(g) inspecting a resulting printed sheet;

(h) adjusting said print station as required based on inspection of said printed sheet in step (g);

(i) repeating steps (d) through (h) until said printed sheet meets specified requirements for a particular job;

(j) documenting at least some print statistics obtained in step (i);

(k) washing said printing instrument while still mounted on said printing plate cylinder;

(l) rinsing said printing instrument while still mounted on said printing plate cylinder;

(m) drying said printing instrument while still mounted on said printing plate cylinder;

(n) repeating steps (a) through (m) for each print station to be used on a particular job;

(o) repeating steps (k) through (n) after a final print station has been adjusted; and (p) removing said printing instrument from said printing plate cylinder.

41. A method, according to claim 40, wherein said printing instrument impression is about 0.005".

42. A method, according to claim 41, wherein during step (l) ink present on said printing instrument is still wet.

43. A printing arrangement diagnostic testing instrument having preselected components for evaluating preselected print characteristics, said diagnostic testing instrument comprising:

(a) at least one printing instrument means for evaluating a plurality of preselected screen values;

(b) at least one printing instrument means for evaluating bar codes;

(c) at least one printing instrument means for evaluating impression;

(d) at least one printing instrument means for evaluating slippage; and (e) at least one printing instrument means for evaluating distortion.

44. A printing arrangement diagnostic testing instrument, according to claim 43, wherein said preselected screen values include about seven line values.

45. A printing arrangement diagnostic testing instrument, according to claim 44, wherein said line values include at least two graduated screen type.

46. A printing arrangement diagnostic testing instrument, according to claim 45, wherein said graduated screen type line values include positive and reverse type.

47. A print analysis system which provides enhanced print quality in a package-type printing system, said print analysis system comprising:

(a) at least one gauge means engageable with at least a portion of a working surface of a printing plate cylinder for establishing parallelism between a working surface of an anilox roll and such working surface of such printing plate cylinder and between a working surface of an impression cylinder and such working surface of such printing plate cylinder and for simultaneously establishing a zero point between such working surfaces of such anilox roll and such printing plate cylinder and between a working surface of an impression cylinder and such working surface of such printing plate cylinder;

(b) a speed synchronization means engageable with at least a portion of such working surfaces of such printing plate cylinder for substantially synchronizing a rotational speed of such working surface of such printing plate cylinder with a feeding speed of a substrate surface to be printed in such package-type printing system;

(c) a documentation means engageable with at least a portion of such working surface of such printing plate cylinder for providing documentation of at least one of screen value and a percent image that is maintained by at least one individual print station in such package-type printing system; and (d) a print characteristic evaluation means engageable with at least a portion of such working surface of such printing plate cylinder for evaluating print characteristics of at least one of positive screens, reverse graduated-type screens, bar codes, solids, impressions, slippage and distortion and for printing a multi-color process graphic which can be analyzed to ensure maintenance of peak print performance in such package-type printing system.

48. A print analysis system, according to claim 47, wherein said gauge means includes:

(a) at least one generally flexible member having each of a predetermined length, a predetermined width and a predetermined thickness, a back surface of said flexible member being engageable with such portion of such working surface of such printing plate cylinder; and (b) a predetermined plurality of sets of indicia formed on an outer surface of said flexible member at predetermined locations, at least two of said sets of indicia represent such zero point.

49. A print analysis system, according to claim 48, wherein said gauge means includes at least three second sets of indicia representing a positive distance, a first of said second sets of indicia representing said positive distance disposed intermediate a first of said sets of indicia representing said zero point and said third of a sets of indicia representing said zero point at a location closely adjacent said first of said sets of indicia representing said zero point, a second of said second sets of indicia representing said positive distance disposed intermediate a second of said sets of indicia representing said zero point and said third of said sets of indicia representing said zero point at a location closely adjacent said second of said sets of indicia representing said zero point and a third of said second sets of indicia representing said positive distance disposed intermediate said first of said sets of indicia representing said zero point and said third set of indicia representing said zero point at a location closely adjacent said third of said sets of indicia representing said zero point.

50. A print analysis system, according to claim 49, wherein said gauge means includes at least three third sets of indicia representing a negative distance, a first of said third sets of indicia representing said negative distance disposed intermediate said first of said sets of indicia representing said zero point and an outer edge of said first end of said gauging instrument at a location closely adjacent said first of said sets of indicia representing said zero point, a second of said third sets of indicia representing said negative distance disposed intermediate said second of said sets of indicia representing said zero point and an outer edge of said axially opposed second end of said gauging instrument at a location closely adjacent said second of said sets of indicia representing said zero point, a third of said third sets of indicia representing said negative distance disposed intermediate said third of said sets of indicia representing said zero point and said second of said sets of indicia representing said zero point at a location closely adjacent said third of said sets of indicia representing said zero point.

51. A print analysis system, according to claim 7, wherein said gauge means includes:

(a) a plurality of generally flexible members, each flexible member having a predetermined length, a predetermined width and a first predetermined thickness, a back surface of said each flexible member being engageable with an outer working surface of such printing plate cylinder;

(b) a plurality of first sets of indicia representing a zero point between such impression cylinder and such printing plate cylinder, said each flexible member having a first set of indicia disposed on an upper surface thereof substantially midway between axially opposed ends thereof, said first sets of indicia having a second predetermined thickness;

(c) a plurality of second sets of indicia representing a positive distance a gap established between such impression cylinder and such printing plate cylinder is from such zero point, at least one second set of indicia is disposed on said upper surface of said each flexible member at a predetermined location intermediate a first predetermined end thereof and said first set of indicia, said second set of indicia having a third predetermined thickness; and (d) a plurality of third sets of indicia representing a negative distance such gap established between such impression cylinder and such printing plate cylinder is from such zero point, at least one third set of indicia is disposed on said upper surface of said each flexible member at a predetermined location intermediate an axially opposed second end thereof and said first set of indicia, said third set of indicia having a fourth predetermined thickness.

52. A print analysis system, according to claim 47, wherein said speed synchronization means includes:

(a) at least one printing instrument member having a back surface thereof engageable with such working surface of such printing plate cylinder disposed in such printing arrangement, said printing instrument member having a predetermined number of predetermined indicia disposed on an upper surface thereof which are positioned at predetermined locations for determining both when slippage occurs and where such slippage occurs during operation of such printing arrangement; and (b) at least one line screen member having a back surface thereof engageable with such working surface of such printing plate cylinder disposed in such printing arrangement, said line screen member having a predetermined number of substantially horizontal lines which create on such substrate surface at least one predetermined character and a predetermined number of substantially vertical lines which create a background for said predetermined character on such substrate surface, said line screen member enabling a determination to be made of at least one of such substrate surface travelling at a greater rate of speed than such printing plate cylinder and such printing plate cylinder travelling at a greater rate of speed than such substrate surface.

53. A print analysis system, according to claim 47, wherein said documentation means includes:

(a) a first printing member having each of a first predetermined width and a first predetermined length and a first predetermined thickness, a back surface of said first printing member being engageable with and securable to a working surface of a printing plate cylinder disposed in such print station of such printing arrangement, said first printing member having a first set of indicia arranged on an axially opposed upper surface thereof, which when printed on a surface of such substrate material will indicate across a predetermined width thereof graduated screen values of a first preselected line value and said percentage of said image maintained by such print station at said first predetermined line value; and (b) a second printing member having each of a second predetermined width and a second predetermined length and a second predetermined thickness, a first elongated edge of said second printing member being disposed adjacent a first elongated edge of said first printing member, a back surface of said second printing member being engageable with and securable to such working surface of such printing plate cylinder, said second printing member having a second set of indicia arranged on an axially opposed upper surface thereof, which when printed on such surface of such substrate material will indicate across a predetermined width thereof screen values of a second preselected line value and said percentage of said image maintained by such print station at said second preselected line value.

* * * * *

UNITED STATES PATENT AND TRADEMARK OFFICE

CERTIFICATE OF CORRECTION

PATENT NO. : 5,072,525

DATED : December 17, 1991

INVENTOR(S) : Ivan N. Philpot and Bruce G. Bittick

It is certified that error appears in the above-identified patent and that said Letters Patent is hereby corrected as shown below:

Column 19, line 30, delete "leas" and insert --least--.

Column 24, line 51, delete "teen" and insert --then--.

Column 30, line 30, delete "7" and insert --47--.

Signed and Sealed this

Twenty-seventh Day of April, 1993

*Attest:*

MICHAEL K. KIRK

*Attesting Officer*

*Acting Commissioner of Patents and Trademarks*